US005672129A

United States Patent [19]

Fisher et al.

[11] Patent Number: 5,672,129

[45] Date of Patent: Sep. 30, 1997

[54] GAME FOR PROJECTING A PROJECTILE WITH A STICK AND COUPLING MEMBERS FOR RELEASABLY ATTACHING THE PROJECTILE TO THE STICK

[75] Inventors: Raymond Earl Fisher, Torrance, Calif.; Elliot Rudell, 1619 Gramercy Ave., Torrance, Calif. 90501; George T. Foster, Long Beach, Calif.

[73] Assignee: Elliot Rudell, Torrance, Calif.

[21] Appl. No.: 751,178

[22] Filed: Nov. 15, 1996

[51] Int. Cl.[6] ..... A63B 67/00

[52] U.S. Cl. ..... 473/471; 273/348.4; 273/DIG. 30; 473/446; 473/560; 473/573

[58] Field of Search ..... 473/471, 446, 473/560, 573, 561, 562, 563; 273/DIG. 30, DIG. 189, 348.4, 108.5

[56] References Cited

U.S. PATENT DOCUMENTS

| | | | |
|---|---|---|---|
| 3,391,933 | 7/1968 | Cooper | 273/108.5 X |
| 3,458,194 | 7/1969 | Coles | 473/563 |
| 4,018,443 | 4/1977 | Bird | 273/108.5 |
| 4,718,677 | 1/1988 | Barnes | 273/DIG. 30 X |
| 4,789,161 | 12/1988 | Waskeld | 273/DIG. 30 X |
| 4,826,173 | 5/1989 | Brown | 473/573 X |
| 5,549,302 | 8/1996 | Lapsker et al. | 273/DIG. 30 X |

*Primary Examiner*—William H. Grieb

*Attorney, Agent, or Firm*—Blakely Sokoloff Taylor & Zafman

[57] ABSTRACT

A toy hockey game which includes a stick and a projectile that both have hook and loop material which releasably attach the projectile to the stick, so that the participants can maintain the projectile in contact with the stick while playing a game of hockey.

8 Claims, 2 Drawing Sheets

GAME FOR PROJECTING A PROJECTILE WITH A STICK AND COUPLING MEMBERS FOR RELEASABLY ATTACHING THE PROJECTILE TO THE STICK

BACKGROUND OF THE INVENTION

1. Field of the Invention

The present invention relates to a toy hockey game that includes a puck which becomes releasably attached to a stick by either magnetic forces or the interaction of hook and loop material.

2. Description of Related Art

Hockey is a sport in which the participants try to hit a puck into a net with a stick. The game is typically played on ice and preferably within a rink. Ice rinks are not always accessible, particularly in places that have temperate weather. Fisher-Price Toys has marketed a product called Fisher-Price SOCCER & HOCKEY which is a toy hockey set that can be played on concrete or grass. The Fisher Price product includes nets, sticks and a puck all constructed from plastic.

Kids who play toys like the Fisher Price SOCCER & HOCKEY set want to emulate the professionals who play the game on ice. Professional hockey players have the skill level to hold the puck adjacent to the stick while skating, so that the player can readily project the puck across the ice. It is much harder to keep the puck adjacent to the stick when playing on concrete or grass because of the higher frictional forces between the playing surface and the puck. Additionally, young players do not have the skills necessary to control a hockey puck in the same manner as the professionals. Consequently, it is difficult for the players to maneuver the puck when playing hockey with a product like SOCCER & HOCKEY. It would be desirable to have a toy hockey game that can be played on concrete or grass, and which would allow the participants to control the projectile in a manner similar to professional hockey players.

SUMMARY OF THE INVENTION

The present invention is a toy hockey game which includes means for releasably attaching a projectile to a stick. The stick and projectile may have attractive magnetic members, or hook and loop material, which secure the projectile to the blade of the stick. The magnetic members, or hook and loop material, are constructed with an attractive force that is weak enough to allow the player to dislodge the projectile by swinging the stick with a force sufficient to overcome the attractive force of the attaching members.

The game is played by swinging a stick and projecting the projectile across a playing field. The projectile is captured by the attractive forces of magnetic members, or hook and loop material of another stick, which maintain the projectile in contact with the stick even while the player moves across the playing field.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
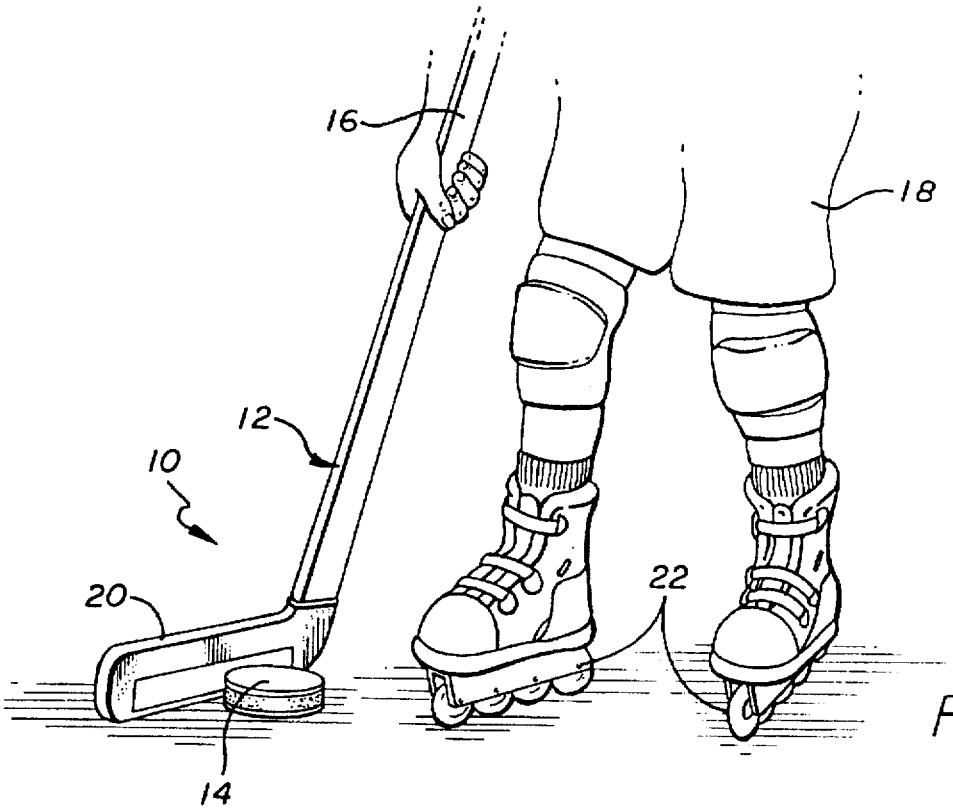
FIG. 1 is a perspective view of a player using a toy hockey game of the present invention.

Referring to the drawings more particularly by reference numbers, FIG. 1 shows a toy hockey game 10 of the present invention. The most basic embodiment of the game includes a stick 12 and a projectile 14. The game 10 may also include nets (not shown) and other devices to assist in playing a game of hockey. The stick 12 has a handle 16 adapted to be grasped by a player 18, and a blade 20 which is used to strike the projectile 14. The game 10 is most commonly played on a concrete surface, wherein the player 18 moves across the surface with roller skates 22. Although a concrete surface is described, it is to be understood that the game can be played on other surfaces including grass or ice. It is preferable to use a cylindrical projectile when the game is played on cement and a spherical projectile when the game is played on grass. It being found that a spherical projectile more readily rolls across the grass than a cylindrical projectile.

Figure 2:
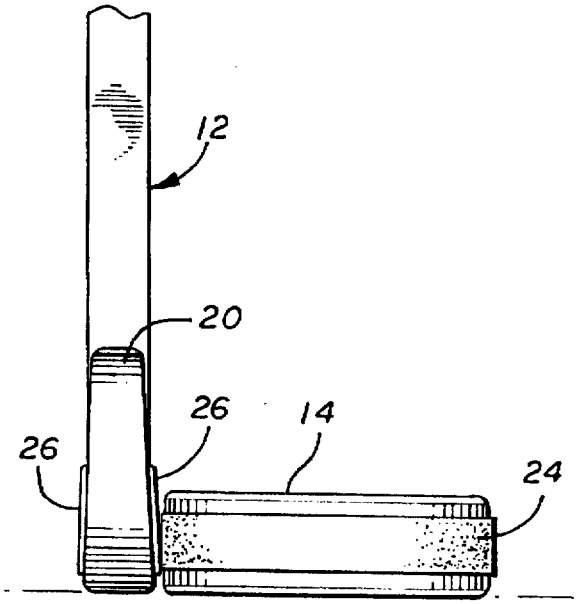
FIG. 2 is a side view showing a puck which has a strip of loop material that is attached to a sheet of hook material mounted on a stick.

As shown in FIG. 2 the projectile 14 may be shaped as a puck that has a strip of loop material 24. The loop material 24 can be attached to a sheet of hook material 26 mounted to the blade 20 of the stick 12. The stick 12 may have hook material 26 on both sides of the blade 20, so that the player can utilize both sides of the stick 12. The hook 26 and loop 24 material maintain the projectile 14 in contact with the stick 12, so that the player 18 can move across the playing surface without losing control of the puck 14. Although the game is described with hook material 26 located on the stick 12 and loop material 24 on the puck 14, it is to be understood that the stick 12 may contain loop material and the projectile 14 may include a strip of hook material.

Figure 3:
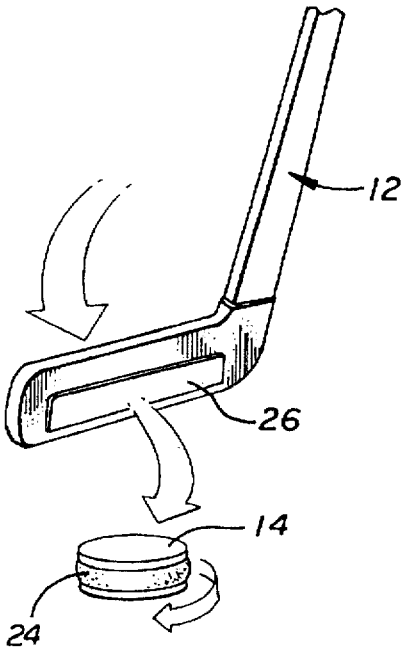
FIG. 3 is a perspective view showing a stick being swung to project the puck across a playing surface.

As shown in FIG. 3, the player can dislodge the puck 14 by swinging the stick 12 with a force sufficient to overcome the attractive force of the hook 26 and loop 24 material. The separation of the hook and loop material also imparts a spin on the projectile 14, thus allowing the player to move the puck along a radial path. In the preferred embodiment, the puck 14 is 3 inches in diameter, 1 inch thick and weighs approximately 92 grams. The strip of loop material 24 is approximately 0.5 inches wide and extends around the circumference of the puck 14. The sheet of hook material 26 is approximately 6.5×1.375 inches.

Figure 4:
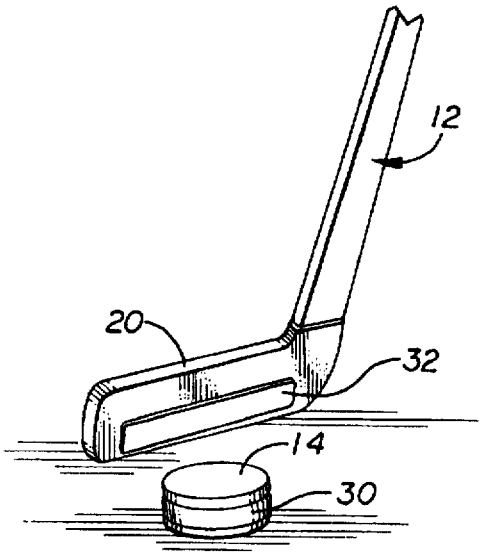
FIG. 4 is a perspective view of an alternate embodiment, wherein the puck has an outer magnetic strip that is attracted to a magnetic plate on the stick.

As shown in FIG. 4, the game may include a strip of magnetic material 30 that is wrapped around the puck 14. The magnetic strip 30 is attracted to a sheet of magnetic material 32 mounted to the blade 20 of the stick 12. The magnetic members 30 and 32 are of opposite polarity and hold the projectile 14 in contact with the blade 20, until the stick 12 is moved with a force sufficient to overcome the magnetic force of the members. As an alternate embodiment, either the stick 12 or puck 14 can have a metal sheet/strip which is attracted to a magnet located on the opposite part. The magnetic sheet 32 may be mounted to the stick 12 with an adhesive, double-sided tape or other fastening means.

Figure 5:
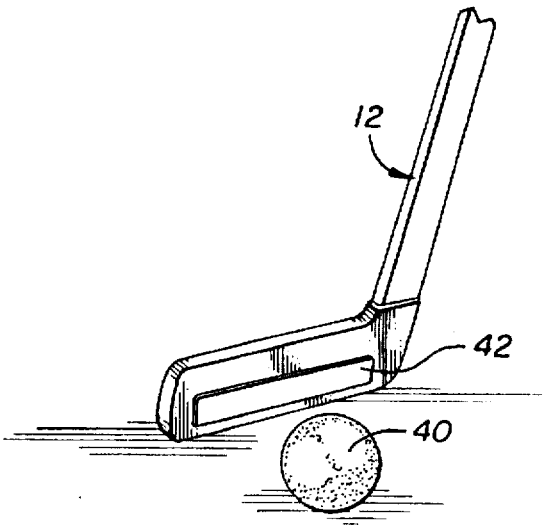
FIG. 5 is a perspective view of an alternate embodiment, wherein the game includes a tennis ball with a nap surface which can be coupled to a sheet of hook mounted on the stick.

FIG. 5 shows a game wherein the projectile is a tennis ball 40. The tennis ball 40 has a nap surface which can be attached to a sheet of hook material 42 located on the stick 12. The tennis ball 40 is particularly useful when the game is played on a playing surface with a high resistance such as grass.

Figure 6:
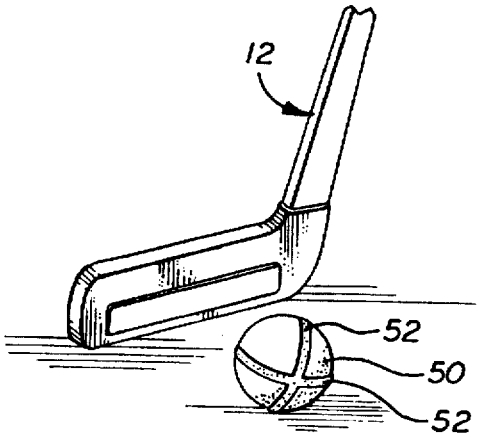
FIG. 6 is a perspective view of an alternate embodiment, wherein the ball has strips of loop material that can be coupled to a sheet of hook material attached to the stick.

FIG. 6 shows an alternate embodiment, wherein the projectile is a ball 50 which has a pair of loop strips 52 that extend around the circumference of the spherical member 50. In the preferred embodiment, the ball 50 has a diameter of 2.675 inches and weighs approximately 34 grams. Each strip 52 is approximately 0.175 inches wide.

Figure 7:
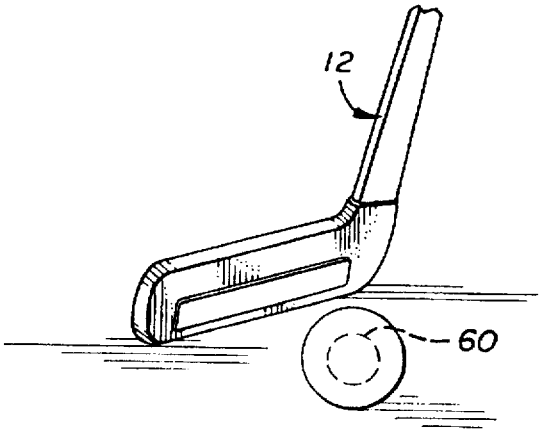
FIG. 7 is a perspective view of an alternate embodiment, wherein the ball contains a magnet which is attracted to a magnetic plate on the stick.
Figure 8:
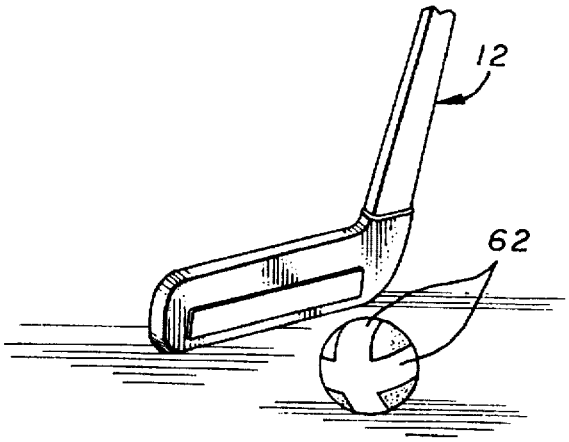
FIG. 8 is a perspective view of an alternate embodiment wherein the ball has magnetic strips that are attracted to a magnetic sheet on the stick.

FIGS. 7 and 8 show alternate embodiments, wherein the projectile has an internal magnet 60 (FIG. 7) or a pair of magnetic strips 62 (FIG. 8). The magnetic members are attracted to corresponding members on the stick 12 as described above.

The game is played by first moving the stick 12 into contact with the projectile 14 so that the projectile 14 is attached to the blade 20. The attractive forces of the magnetic members, or hook and loop material, allows the player to move across the playing surface without the projectile 14 becoming separated from the stick 12. The game thus provides the participants with greater control of the projectile while moving the stick across the playing field. The attractive forces of both the magnetic members and the hook and loop material are constructed to be small enough so that the player can readily project the puck/ball across the playing surface by merely moving the stick 12.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method for a player to play a game of hockey on a playing surface, comprising the steps of:

a) providing a stick which has a hook material on a blade, and a projectile that has a loop material;

b) holding said stick by the player;

c) moving said stick across the playing surface so that said stick is adjacent to said projectile, wherein said loop material becomes attached to said hook material of said stick; and, d) moving said stick to separate said projectile from said stick.

2. The method as recited in claim 1, wherein said projectile is a puck.

3. The method as recited in claim 1, wherein said projectile is a ball.

4. The method as recited in claim 1, wherein the player skates across the playing surface.

5. A method for a player to play a game of hockey on a playing surface, comprising the steps of:

a) providing a stick which has a loop material on a blade, and a projectile that has a hook material;

b) holding said stick by the player;

c) moving said stick across the playing surface so that said stick is adjacent to said projectile, wherein said hook material becomes attached to said loop material of said stick; and, d) moving said stick to separate said projectile from said stick.

6. The method as recited in claim 5, wherein said projectile is a puck.

7. The method as recited in claim 5, wherein said projectile is a ball.

8. The method as recited in claim 5, wherein the player skates across the playing surface.

* * * * *